United States Patent [19]

Hackbarth et al.

[11] 4,102,212

[45] Jul. 25, 1978

[54] RAILWAY FLAT CAR HAND BRAKE SYSTEM

[75] Inventors: Richard W. Hackbarth, Roseville; Douglas A. Puariea, St. Paul, both of Minn.

[73] Assignee: The Maxson Corporation, St. Paul, Minn.

[21] Appl. No.: 748,120

[22] Filed: Dec. 6, 1976

[51] Int. Cl.[2] ..... F16H 27/02

[52] U.S. Cl. ..... 74/89.22; 188/107

[58] Field of Search ..... 74/89.20, 89.21, 89.22, 74/96; 188/33, 34, 107, 124

[56] References Cited

U.S. PATENT DOCUMENTS

| | | | |
|---|---|---|---|
| 1,989,964 | 2/1935 | Beckler | 74/89.22 |
| 3,163,128 | 12/1964 | Enochian | 188/34 |
| 3,344,895 | 10/1967 | Holden et al. | 188/107 |

FOREIGN PATENT DOCUMENTS

| | | | |
|---|---|---|---|
| 979,217 | 12/1950 | France | 74/89.22 |

*Primary Examiner*—Benjamin W. Wyche
*Assistant Examiner*—Wesley S. Ratliff, Jr.
*Attorney, Agent, or Firm*—Neil B. Schulte

[57] ABSTRACT

A flat car hand brake system in which a vertical wheel, high powered hand brake is positioned horizontally below the deck to provide load clearance. An adjustable chain takeup system moves the idle portion of the brake chain at exactly the same rate as the loaded or pulled portion of the chain to prevent any slack which would cause fouling.

7 Claims, 8 Drawing Figures

RAILWAY FLAT CAR HAND BRAKE SYSTEM

BACKGROUND OF THE INVENTION

The prior art relative to railway hand brake systems recognizes basically only two types of hand brakes. The first type is the standard drop staff hand brake, which utilizes a horizontal hand wheel, while the second type is a vertical wheel hand brake. The limited market demand does not permit the profitable sale of a wider variety of hand brakes. Accordingly, it is necessary for designers to use one of these two brakes or else face exorbitant expense in the production of a custom unit.

In the past, designers have been able to use these two brakes for most situations but recent changes in safety regulations coupled with the development of ever larger flat cars have created problems which our invention resolves. It is now required that a single hand brake must operate at least 50% of the wheels on the car and be capable of producing enough force to meet the minimum hand brake force requirements. With very large and heavy flat cars this requirement demands a vertical wheel, high powered hand brake. However, a vertical wheel, high powered hand brake extends above the level of the flat car's deck and interferes with the loading of the flat car thus reducing its utility. The present invention avoids this problem.

BRIEF SUMMARY OF THE INVENTION

Briefly, our invention makes use of the economically available, high powered, vertical wheel hand brake by moving it to a horizontal position underneath the deck of the flat car. In this position the hand wheel can be made low enough to allow the flat car to be loaded above it or, in the alternative, the hand wheel can be completely removed. However, high powered hand brakes are not designed to operate in a horizontal position, as they have loose chain which normally drops out of the bottom, by gravity, which chain now operates to quickly jam the mechanism. The present invention avoids this by introducing a chain takeup system designed to remove excess chain from the hand brake at exactly the correct rate to prevent fouling. The chain is routed through a series of sheaves and angled back behind the brake actuating lever where it is connected to the same pivot point as the powered or pulled side of the chain so as to move in unison therewith. Thus, as the powered side of the chain moves the brake lever it also moves the idle portion of the chain so that no slack can develop. It may therefore be seen that it is an object of our invention to provide an improved hand brake system for modern heavy duty railway flat cars. Further objects and advantages will become apparent from the following detailed description and drawings.

DESCRIPTION OF THE PREFERRED EMBODIMENT

Figure 1:
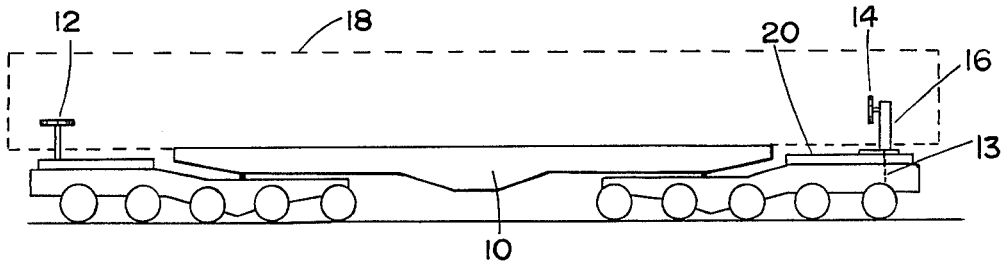
FIG. 1 (PRIOR ART)
FIG. 1 is a schematic drawing of a heavy duty flat car common to the prior art and showing the two types of standard hand brakes thereon.

In FIG. 1 a prior art heavy duty flat car 10 is shown with a standard drop staff hand brake 12 on the left end and a vertical wheel, high powered hand brake 14 on the right end. Drop staff brake 12 may be of the type designated model 1180 while brake 14 may be of the type designated model 1070, both manufactured by the Peacock Brake Company of Totowa Boro, N.J. For large loads occupying the space designated by dashed line 18 it is desirable to be able to remove the interfering hand brakes. Drop staff brake 12 is easily lowered, because it uses a drum upon which the brake actuating chain rolls up. The heavy duty vertical wheel brake cannot be lowered, however, because the gear box 16 must remain in the position shown so that the idler or excess chain 13 can drop vertically out of the bottom. No provision is made for chain storage in the heavy duty brake 14 because of the need for a reduction gear box 16, the heavy forces involved, and the requirement of unlimited chain takeup. Furthermore, the brake must remain fully operable and can not be removed as this would be objectionable from a safety standpoint. Accordingly, the load 18 must be limited to a smaller area on heavy duty cars in order to be able to use the regulation required heavy duty brake 14. This limitation defeats the very purpose of a heavy duty flat car and has been a serious problem to date.

Figure 2:
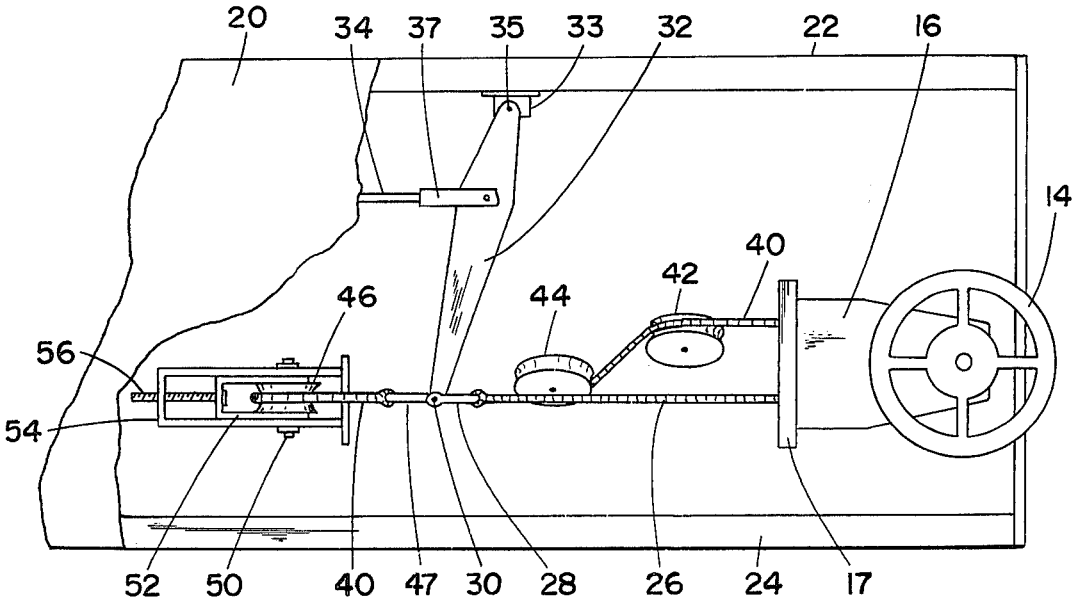
FIG. 2 and FIG. 3 are, respectively, top plan and side elevational views of one embodiment of the hand brake system of the present invention.
Figure 3:
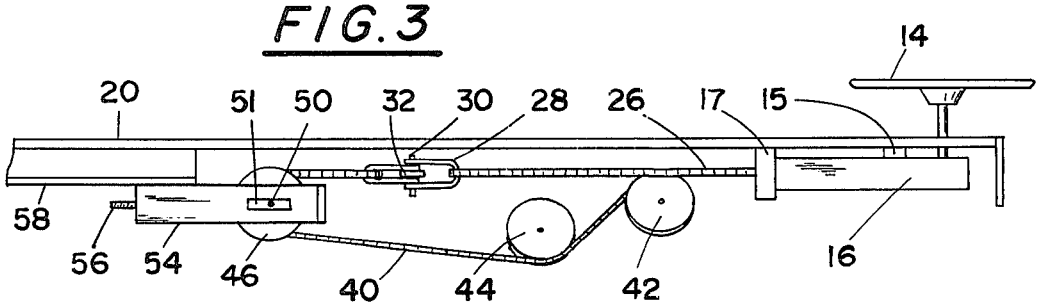

The present invention overcomes this problem by laying down the gear box 16 in a horizontal position beneath deck 20 as shown in FIGS. 2 and 3. Now, with a short shaft, wheel 14 is below the load level or may be removed completely leaving a flush deck 20. The gear box 16 is connected to the underside of the deck by a suitable spacing block 15 and flange 17. Instead of running the pulled or powered chain 26 over a sheave to the brake rigging, the chain is routed directly to a shackle 28 which fastens to a pin 30 through the end of a lever 32. Lever 32 pivots on the fulcrum pin 35 secured in a bracket 33 on frame member 22. A suitable connector 37 and rod 34 transmits the braking force to the conventional brake rigging. The idle chain 40 is pulled out of the housing to prevent the mechanism from jamming. Sufficient tension is maintained on chain 40 to keep it firmly engaged on the gears in the brake housing so as to prevent accidental slippage and brake release. To insure that the idle chain 40 is extracted at the same rate as the powered chain enters the brake mechanism, the idle chain 40 is passed over a return means comprising a pair of sheaves 42 and 44 and up around a sliding adjustable sheave 46 to connect with a shackle 47 which is mounted to the back side of lever 32. It may be seen that the idle chain 40 moves the exact same distance as the powered chain 26 but in the opposite direction. To maintain tension on the chain and avoid any possibility of jamming in gear box 16, sheave 46 is mounted in a sliding U-shaped bracket 52 by means of an axle 50. Axle 50 slides along a pair of horizontal slots 51 in the sides of a slightly larger U-shaped bracket 54 which is mounted to the underside of the flat car as, for example, to a longitudinal frame member 58. An adjustment screw 56 permits U-shaped bracket 52 to slide horizontally inside U-shaped bracket 54.

Figure 4:
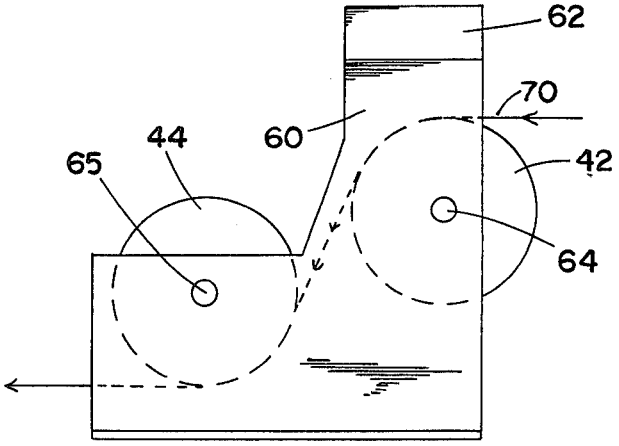
FIGS. 4 and 5 show side and end views of the sheave mounting bracket for properly routing the idler chain.
Figure 5:
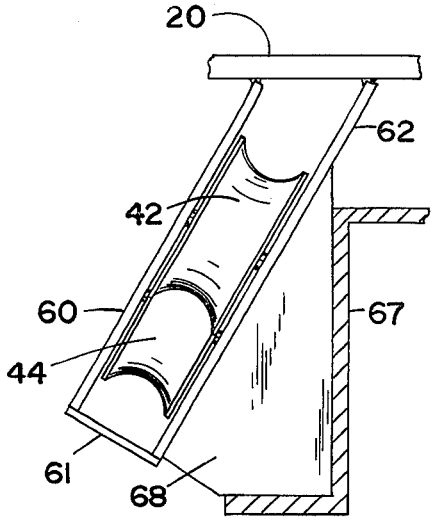

Sheaves 42 and 44 are shown schematically only in FIGS. 2 and 3. One possible method for mounting these two sheaves is shown in FIGS. 4 and 5. Sheaves 42 and 44 are carried respectively on axles 64 and 65 between a pair of mounting plates 60 and 62. Plate 62 is longer than plate 60 so that when they are welded to the underside of deck 20, as shown, the sheaves are positioned at the appropriate angle to bring the chain back to a position directly underneath the powered chain 26. At the lower end plates 60 and 62 are reinforced by a cross brace 61 and fastened by a web 68 to a longitudinal channel 67 which could comprise another one of the longitudinal frame members of the flat car. The chain would follow the path indicated by arrows 70 in FIG. 4.

Figure 6:
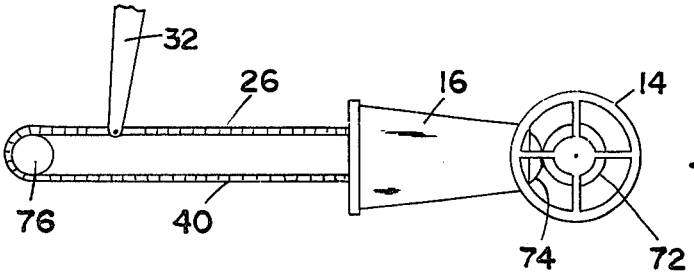

Variations to the structure are possible without departing from the spirit and scope of the invention. For example, one variation is shown in FIG. 6 wherein brake housing 16 is turned over causing idle chain 40 to emerge on the side beyond the end of lever 32. Since the hand wheel shaft now points downward, it is connected to a gear 74 to be driven by a gear 72. Gear 72 may be connected to the hand wheel 14 with a suitably mounted shaft. Although this embodiment complicates the brake mechanism itself, it much simplifies the chain takeup system which now requires only one sheave 76 which may be adjustable in the manner of sheave 46 in FIG. 3.

Figure 7:
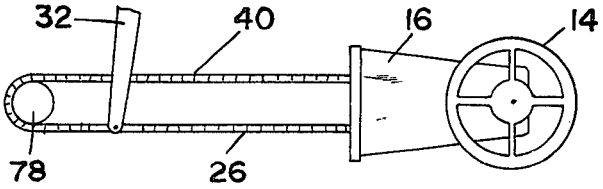
FIGS. 6, 7, and 8 show other embodiments of our invention.
Figure 8:
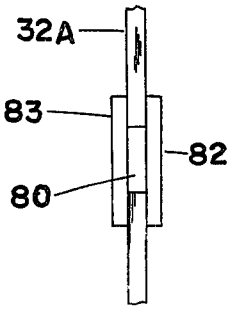

To avoid the complicated gears needed when the housing 16 is turned over, but still retain the simpler chain takeup system, the variation of FIG. 7 may be used. With this arrangement housing 16 is positioned as in FIGS. 2 and 3 with the idle chain 40 passing just beside lever 32. A single sheave 78, which again may be moved to adjust tension, returns the chain 40 to the back of lever 32. Sheave 78 may be slightly inclined to help chain 40 slide past the lever. Yet alternative is shown in FIG. 8 where idle chain 40 can pass directly through a hole 80 in the center of lever 32A formed by a pair of brace members 82 and 83. This embodiment allows the housing 16 and the sheave 78 to remain in horizontal planes. Clearly other variations would also be possible and we therefore intend to be limited only to the following claims.

We claim:

1. In a hand brake system for use with a railway flat car of the type in which the brakes are activated by suitable mechanical linkage connecting the brakes to a standard vertical wheel high powered hand brake of the non-reel type wherein a pulled chain from the vertical wheel hand brake is connected to the mechanical linkage and an idle chain drops loosely out of the brake housing, the improvement comprising the positioning of said vertical wheel hand brake horizontally below the flat car deck with the shaft for the hand wheel extending up through the deck; and with a movable member connected to operate the mechanical linkage;

a connection point between the pulled chain from the vertical wheel hand brake and said movable member; and an idle chain take up and return means positioned to convey the idle chain from the vertical wheel hand brake to said movable member connection point employed by the pulled chain but from the side of the member opposite the pulled chain.

2. The system of claim 1 in which said movable member comprises a generally horizontal movable lever.

3. The system of claim 2 in which said take up and return means comprise at least one sheave positioned to return the idle chain to the opposite side of said movable lever member.

4. The system of claim 2 in which said take up and return means comprise three sheaves used to convey said idle chain to a position generally in line with and under said pulled chain, under the lever, and back to the opposite side of the lever.

5. The system of claim 4 in which two of the sheaves are mounted on parallel axles which axles are carried by a pair of plates mounted to the under side of the flat car at an angle to the plane of the deck.

6. The system of claim 3 in which said vertical wheel hand brake is positioned inverted and connected to a hand wheel through gears so as to permit the idle chain to clear said lever.

7. The system of claim 3 in which said lever is configured to include a passageway therethrough to permit the passage of said idle chain.

* * * * *